United States Patent [19]

Itaya et al.

[11] Patent Number: 5,075,726

[45] Date of Patent: Dec. 24, 1991

[54] TONER DENSITY CONTROL DEVICE WITH ADJUSTABLE REFERENCE VALUES FOR MULTIPLE DEVELOPER COPIER

[75] Inventors: Masahiko Itaya; Atsushi Saito, both of Hachioji, Japan

[73] Assignee: Konica Corporation, Tokyo, Japan

[21] Appl. No.: 557,209

[22] Filed: Jul. 24, 1990

[30] Foreign Application Priority Data

Jul. 28, 1989 [JP] Japan ..... 1-193830
Jul. 28, 1989 [JP] Japan ..... 1-193831

[51] Int. Cl.[5] ..... G03G 21/00

[52] U.S. Cl. ..... 355/246; 118/689; 355/208; 355/326

[58] Field of Search ..... 355/208, 246, 326, 327; 118/688, 689, 690, 691

[56] References Cited

U.S. PATENT DOCUMENTS 4,141,645 2/1979 Reid et al. ..... 355/246
4,932,356 6/1990 Watanabe et al. ..... 355/246 X
4,955,317 9/1990 Kinoshita et al. ..... 355/326 X
4,956,668 9/1990 Arnold et al. ..... 355/208

*Primary Examiner*—A. T. Grimley
*Assistant Examiner*—Christopher Horgan
*Attorney, Agent, or Firm*—Frishauf, Holtz, Goodman & Woodward

[57] ABSTRACT

A toner density control device of an electrophotographic recording apparatus in which development is conducted by a plurality of developing units with two-component developer wherein a toner density detecting device can detect the density of toner loaded in the plurality of developing units according to the variation of magnetic permeability of the developer. The detecting device is composed of a sensor provided to each developing unit, and a signal processing unit to process the output of the sensor selected by a selector. And toner is supplied according to the difference between the detected value of the detecting device and the reference value which is previously established.

24 Claims, 4 Drawing Sheets

TONER DENSITY CONTROL DEVICE WITH ADJUSTABLE REFERENCE VALUES FOR MULTIPLE DEVELOPER COPIER

BACKGROUND OF THE INVENTION

This invention relates to a toner density control device of an electrophotographic recording apparatus such as a copier and a printer in which development is conducted by a plurality of developing units with two-component-developer.

DESCRIPTION OF THE PRIOR ART

In a conventional developing apparatus in which two-component-developer is used, the toner density in the developer is detected and controlled so that the value of density can be maintained constant. The following conventional methods to detect the toner density have been known: a method in which an adequate size of toner image is formed on a photoreceptor and the reflectivity of the image is measured so that the toner density can be known from the variation of the reflectivity; an inductance detecting method in which the mixing ratio of the carrier, which is a magnetic substance, and the toner, which is a non-magnetic substance, can be measured in the form of the variation of magnetic permeability; and furthermore a method in which the volume percentage of toner is utilized in order to detect the toner density.

Among the methods mentioned-above, the inductance detecting method is characterized by that it is superior to other methods in detecting ability In the conventional inductance detecting method, a magnetic sensor unit composed of a coil and an amplifier unit to amplify the output from the coil, are integrally provided to a developing unit. When this method is applied to a recording apparatus such as a color electrophotographic apparatus having a plurality of developing units, the above-described sensor unit combined with the amplifier is provided to each of the developing units. Therefore, sensors and amplifiers, the number of which corresponds to the number of developing units (for example 4 sets), must be provided to the apparatus. Accordingly, as the number of parts is increased, the cost of the apparatus is increased. Furthermore, the characteristic of each sensor differs. Consequently, it is troublesome to adjust each sensor in order to equalize its characteristic.

SUMMARY OF THE INVENTION

This invention has been achieved in order to solve the problems described above. The object and composition of the invention will be explained as follows. The object of the invention is to provide a toner density control device in which development is conducted by a plurality of developing units with two-component-developer, and which is characterized in that: the first object of the invention is to accurately control the toner density by a device with a simple structure; in order to attain the first object, a toner density detecting device is provided, wherein the device can detect the density of toner loaded in a plurality of developing units, according to the variation of magnetic permeability of the developer; the toner density detecting device is composed of a sensor unit provided to each developing unit, a selecting means to select the output of the sensor unit, and a signal processing unit to process the output of the sensor unit selected by the selecting means; and toner is supplied according to the difference between the detected value of a detecting means and the reference value which is previously established.

The second object of the invention is to equalize the variations among the sensors and among the developing units by a simple adjusting operation. In order to attain the object described above, the present invention is essentially composed as follows. Each developing unit is provided with a sensor to output electrical signals according to the variation of the magnetic permeability of developer; the signal from the sensor is selectively outputted to a signal processing means; the signal is processed by the signal processing means according to a predetermined adjustment value. The above-described adjustment value is established at each developer by the initial setting operation conducted in an operation means s that the output of the signal processing means can become a predetermined reference value.

In an actual developing operation, the adjustment value established by an adjustment value setting means, is given to the signal processing means, and the output of the signal processing unit and the above-described reference value are compared at each developer. Toner is supplied to each developing unit according to the difference between the output and the reference value.

DESCRIPTION OF THE PREFERRED EMBODIMENTS

Figure 1:
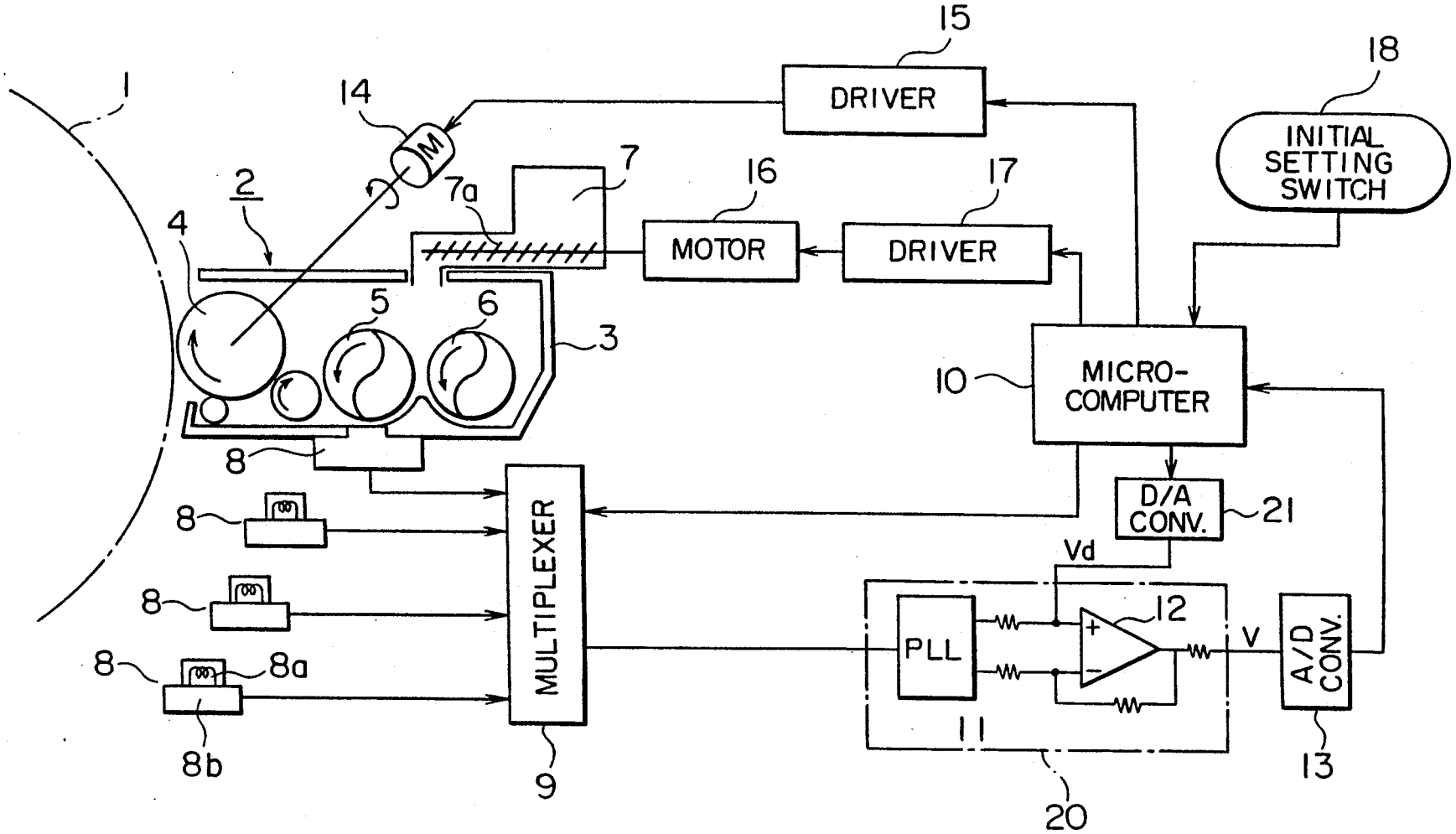
FIG. 1 is a block diagram of the main portion of a color laser printer to which the toner density control device of the present invention is provided.

Referring to the drawings, the preferred embodiments of the present invention will be described as follows.

FIG. 1 is a block diagram which shows the main portion of a color laser printer provided with the toner density control device of the present invention.

In the drawing, the numeral 1 is a photoreceptor drum. The numeral 2 is a developing unit. As far as the developing unit is concerned, four developing units, which are the first, second, third and fourth developing units, and which are used for color toners and a black toner, are provided along the circumferential surface of the photoreceptor drum 1. In FIG. 1, only the first developing unit is illustrated. However, the second, third and fourth developing units are provided in the same way.

The developing unit 2 in FIG. 1 comprises the developing roller 4 installed in the housing 3, the stirring screws 5 and 6, the hopper 7 to supply toner and the toner density sensor 8 installed below the stirring screw 5.

The sensor 8 is composed of the coil 8*a* and the oscillation circuit 8*b*. An alternating current of a predetermined frequency is supplied from the oscillation circuit 8b to the coil 8a. The magnetic flux generated by the electrical current in the coil 8a, passes through the developer in the housing 3. When the toner in the developer is consumed, the density of magnetic substance is changed. Accordingly, the magnetic permeability of the developer is changed, so that the inductance of the coil 8a is changed. When the inductance of the coil 8a is changed, the phase of the electric current in the coil is changed. Therefore, the toner density can be detected by detecting the change of the phase.

The output of each sensor 8 is sent to the analog multiplexer 9. The multiplexer 9 sends the signal of one of the four sensors 8 to the PLL (phase-locked-loop) circuit 11 according the selection signal sent from the microcomputer 10. In the PLL circuit 11, the phase difference between the output electric current of the sensor 8 and the reference current in PLL circuit 11, is detected and the detected difference is outputted to the operation amplifier 12 in the form of a voltage value. This voltage value is amplified by the operation amplifier 12 and converted into a digital value by the A/D converter 13, and then the converted value is outputted to the microcomputer 10. The processing unit 20 is composed of the PLL circuit 11 and the operation amplifier 12.

In this example, the toner density detecting means by which the toner density in the developer can be detected, is composed of 4 sensors 8 provided to each developing unit, the multiplexer 9 which selects the output of the sensors, the PLL circuit 11, and the operation amplifier 12.

Figure 2:
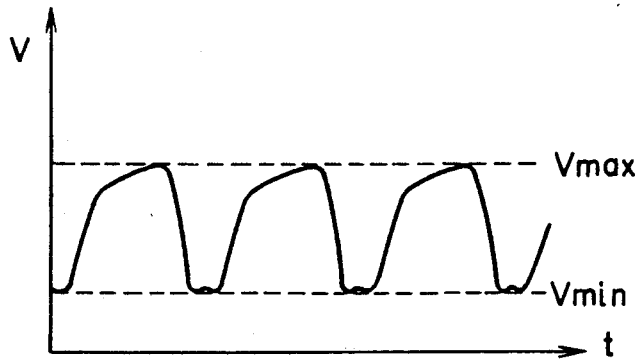
FIG. 2 is a waveform diagram of the output voltage of an operation amplifier.
Figure 3:
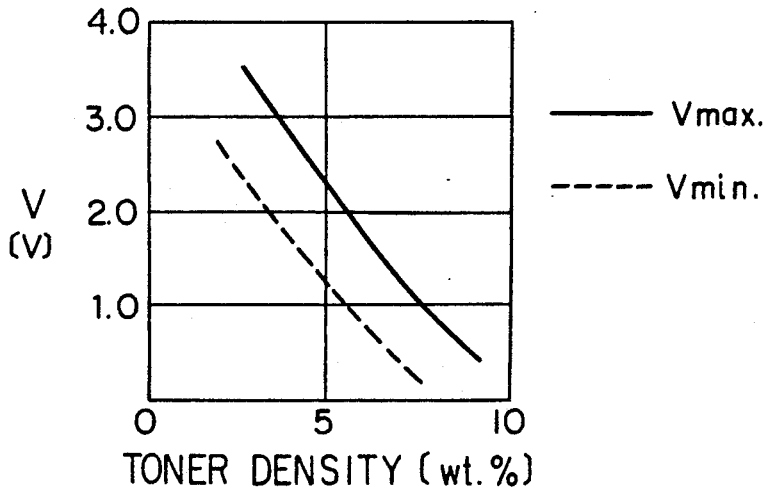
FIG. 3 and FIG. 5 are graphs which show the relation between the output voltage of the operation amplifier and the toner density.

FIG. 2 is a waveform diagram of the output voltage of the operation amplifier 12. The output voltage is periodically changed in the range of Vmax and Vmin. The above-described change of output voltage is caused by the influence of the magnetic permeability of the rotating stirring screw 5. Vmax and Vmin are almost linearly changed according to the change of toner density (refer to FIG. 3). Vmin, upon which the permeability of the stirring screw 5 exerts a relatively small influence, is sampled synchronously with the rotation of the stirring screw 5, and the toner density is detected from the sampled Vmin.

Referring to FIG. 1, the numeral 14 is a development motor by which the developing roller 4 and the stirring screws 5 and 6 are rotated. The numeral 15 is a driver by which the developing motor 14 is driven according to the signal sent from the microcomputer 10. The numeral 16 is a motor by which the conveyance screw 7a of the hopper 7 is driven. The numeral 17 is a driver by which the motor 16 is driven. The numeral 18 is an initial setting switch which is used as an operation means to set the reference value of toner supply. The switch 18 is substituted by a ten key in a printer operating unit, for example.

Before this device is actually used as the output unit, the reference value which is used as the standard to supply toner, is initially established by a manufacturer in the manufacturing process or by a user. When the reference value is established, the developing unit is loaded with unused developer or standard developer. However, the reference value can be established not only under the conditions described above but also under the conditions that the magnetic permeability which can be used as the reference is given to each sensor 8 which is provided to each developing unit 2.

Figure 4:
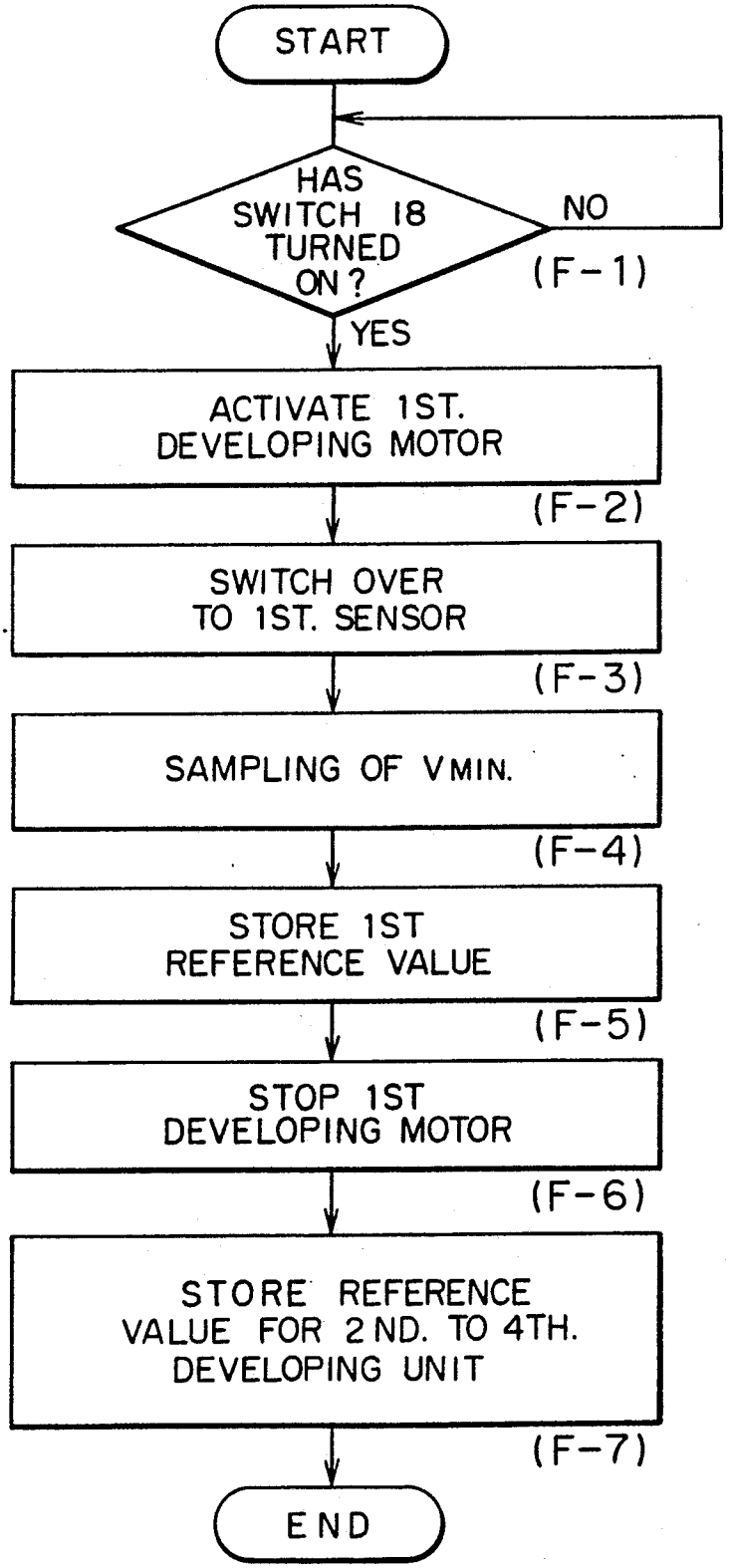
FIG. 4 is a flow chart which explains the initial setting operation of the reference value, wherein the reference value is used when toner is supplied.

Referring to the flow chart in FIG. 4, the initial establishing operation of the reference value used as the standard of toner supply, will be explained.

At the outset, the switch 18 is turned on by a manual operation (F-1). Then, the developing motor 14 of the first developing unit 2 is rotated (F-2), and the development roller 4 and the stirring screws 5 and 6 are rotated. The multiplexer 9 is switched over so that only the output signal sent from the sensor 8 of the first developing unit can be inputted (F-3). According to the output signal sent from the sensor 8 of the first developing unit, the above-described Vmin is sampled for a predetermined period (F-4). The sampled value is defined as the first reference value and stored in a non-volatile storage, for instance (F-5). Then, the first development motor is stopped (F-6). After that, the same operations as (F-2) to (F-5) are conducted to the second, third and fourth developing units, and the reference values of the second, third and fourth developing units are obtained at each developer and stored (F-7). In this way the initial establishing operation of the reference value is completed.

In the actual developing operation of a printer, the output of each sensor 8 is monitored in order and the output of each sensor 8 is compared with the reference value which was previously established in the initial establishing stage. When the output is deviated from the reference value by more than a predetermined value, it can be judged that the toner density is lowered, so that the conveyance screw 7a is rotated by the motor 16 to supply toner from the hopper 7.

Figure 5:
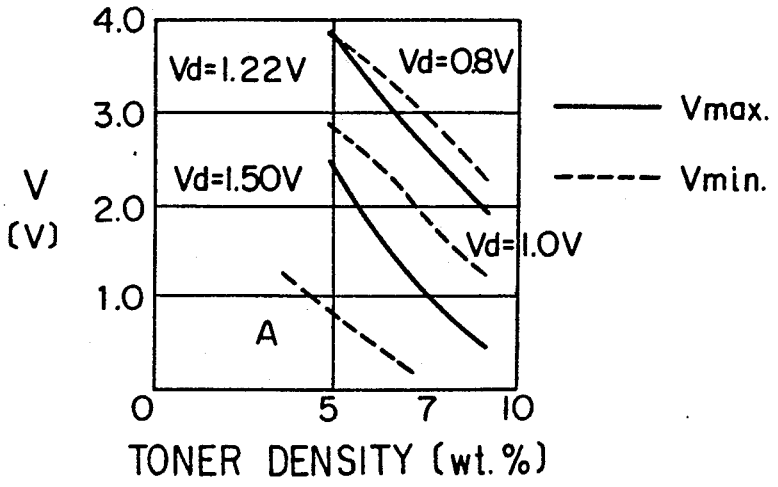

In addition to the composition to accomplish the first object of the invention, in the case of the example to accomplish the second object, the adjustment voltage Vd is impressed on the input terminal of the operation amplifier 12 from the D/A converter 21. Furthermore, the numeral 18 is an initial setting switch, which is the operation means for initial setting of the adjustment voltage Vd. The switch 18 is substituted by a ten key of the printer operation unit, for instance. However, as illustrated in FIG. 5, the values of Vmin do not necessarily show the same characteristic since the characteristic of the sensor 8 varies and the characteristic of the developing unit provided with the sensor 8, varies. For that reason, the output voltage V of the operation amplifier 12 is adjusted by impressing the adjustment voltage Vd on the input side of the operation amplifier 12. This adjustment is conducted, for instance, in such a manner that: the developing unit is loaded with unused developer or standard developer; and the output voltage V of the operation amplifier 12 is adjusted at each developer so that it can become a predetermined reference voltage.

The details of this operation will be explained referring to FIG. 5. As illustrated in the drawing, Vmax and Vmin are shifted according to the value of the adjustment voltage Vd. When the adequate toner density is set to 7%, for instance, and when Vmin is set to 2V corresponding to the toner density, it can be understood that the output voltage V can be positively detected in the range of 5 to 10%. Accordingly, at the stage of initial setting previous to the actual use of the developing unit, the adjustment voltage Vd is determined and stored so that the output voltage Vmin of the operation amplifier 12 can become 2V when the developing unit is loaded with unused developer or standard developer. In the actual developing operation, the adjustment voltage Vd established in this way is impressed on the input terminal of the operation amplifier 12 according to the developer to be detected, and the output voltage Vmin of the operation amplifier 12 is compared with the reference voltage 2V at each developer, and then the toner is supplied to each developing unit according to the difference.

Figure 6:
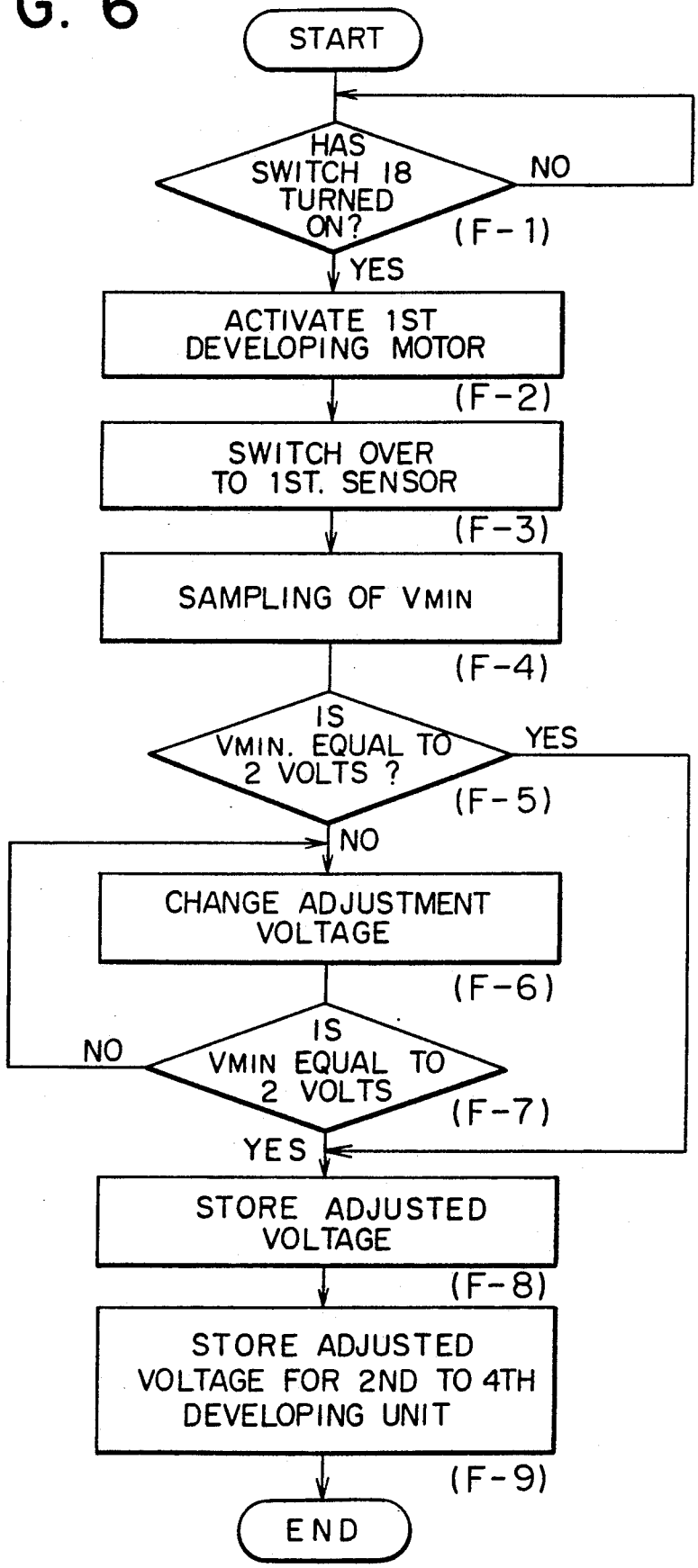
FIG. 6 s a flow chart which explains the initial setting operation of the adjustment voltage.

Referring to the flow chart in FIG. 6, the setting operation of the adjustment voltage Vd will be explained in more detail.

At the outset, the switch 18 is turned on by a manual operation (F-1). Then, the operation of the device is performed through the processes (F-2), (F-3) and (F-4) in the same way as the example to accomplish the first object. Then, it is judged whether Vmin=2V or not (F-5). When Vmin is not equal to 2V, the adjustment voltage Vd which is impressed on the input terminal of the operation amplifier 12 through the D/A converter 21, is changed so that Vmin can become equal to 2V (F-6). It is checked again whether Vmin=2V or not (F-7). When Vmin is equal to 2V, the adjustment voltage is stored in the non-volatile storage, for example (F-8).

Then, the operation of the steps (F-2) to (F-8) is conducted to the second developing unit to the fourth developing unit in the same way. The second, third and fourth adjustment voltages are determined in order at each developer and the determined values are stored (F-9). In this way, the initial setting operation of the adjustment voltage is completed.

In the actual developing operation of a printer, the output of the sensor 8 of each developing unit is monitored in order. At that moment, the adjustment voltage established in the above-described initial setting, is impressed on the input terminal of the operation amplifier 12 according to the selected sensor. The output Vmin of the operation amplifier 12 is compared with the reference value 2V, and when the output Vmin is deviated from the reference value 2V by more than a predetermined value (for example 2.5V), it is judged that the toner density has been decreased, and the conveyance screw *7a* is rotated by the motor 16 so that the constant amount of toner or the amount of toner reciprocal to the variation of toner density, is supplied.

When the device has the structure explained above, the toner density can be positively controlled even if the characteristics of the sensors and the developing units differ. For example, when Vmin is the value indicated by "A" in FIG. 5, the toner density can be only detected at most in the range of 5 to 7%. However, in the case of the example, the proper adjustment voltage Vd is impressed and the output is corrected so that the output voltage can become 2V when the toner density is 7%. Consequently, the toner density can be positively detected in the desired range.

In the above-described example, the initial setting of the adjustment voltage Vd was conducted under the condition that unused developer or standard developer was loaded to the developing unit. However, the present invention is not limited to the specific example. To sum up, each sensor 8 should be given the standard magnetic permeability under the condition that each sensor 8 is provided to each developing unit 2.

In the above-described two examples, the change of the magnetic permeability of developer was measured in the form of the change of the inductance of a coil, and the change of the magnetic permeability was detected in the form of the change of the phase of electric current in the coil. However, the invention is not limited to the specific example. Other publicly known methods may be used. For example, the change of magnetic permeability of developer may be detected in the form of the change of a resonance frequency, an electric current or an amount of electric charge. The sensor used in the invention is not limited to a coil. For example, the Hall element can be used.

The conventional electrophotographic recording device in which development is conducted by a plurality of developing units with two-component-developer, has the following disadvantages: when toner density needs to be controlled accurately, a plurality of sensors are necessary, so that it is complicated to adjust and control the sensors; and as a result, the cost is increased. According to the present invention, the toner density can be accurately controlled by a device of simple composition at a low cost.

What is claimed is:

1. A toner density control device of an electrophotographic recording apparatus in which development is conductor by a plurality of developing means with a two-component developer, comprising:

(a) a plurality of sensing means provided, respectively, in association with said plurality of development means for detecting a toner density of said developer in the respective developing means, and varying a characteristic value thereof in response to changes in the toner density;

(b) means for generating a reference signal of a given type and having a given value;

(c) signal means for processing the characteristic value of any one of said plurality of sensing means to provide a density signal which is comparable with said reference signal value;

(d) control means for comparing said density signal with said reference signal to provide a comparison result, and for controlling toner supply to the developing means corresponding to the selected sensing means based on the comparison result; and (e) selecting means for selecting said plurality of sensing means to be coupled to said signal means one at a time.

2. The toner density control device of claim 1, wherein the characteristic value is an inductance.

3. The toner density control device of claim 1, wherein the characteristic value is a phase of the electric current in the sensing means.

4. The toner density control device of claim 1, wherein the characteristic value is a resonance frequency for detecting a permeability of the developer in accordance with the toner density.

5. The toner density control device of claim 1, wherein said sensing means comprises a Hall element.

6. The toner density control device of claim 1, further comprising memory means for storing an initial value of said sensing means, obtained when said developer has a known density, as said reference value for each of said plurality of developing means.

7. The toner density control device of claim 6, wherein said memory means is a non-volatile memory means.

8. The toner density control device of claim 1, wherein said selecting means comprises a multiplexer.

9. The toner density control device of claim 1, wherein the signal means comprises a phase-locked loop.

10. A toner density control device of an electrophotographic recording apparatus in which development is conducted by a plurality of developing means with a two-component developer, comprising:

(a) a plurality of sensing means provided, respectively, in association with said plurality of development means for detecting a toner density of said developer in the respective developing means, and having a characteristic value thereof which is variable in response to changes in the toner density;

(b) selecting means for selecting one of said plurality of sensing means;

(c) signal means for outputting a density signal corresponding to the characteristic value of the selected sensing means;

(d) adjustment value setting means for individually setting respective initial adjustment values for said plurality of developing means so that the output value of the signal means is the same as a predetermined reference value, wherein for each one of said plurality of developing means said output value of the signal means is a combination of said initial adjustment value and the characteristic value outputted by an associated sensing means for a given toner density of said developer; and (e) control means for comparing an actual value of the outputted density signal with said predetermined reference value, and for controlling toner supply to the developing means associated with the selected sensing means based on the comparison result.

11. The toner density control device of claim 10, wherein the characteristic value is an inductance.

12. The toner density control device of claim 10, wherein the characteristic value is a phase of the electric current in the sensing means.

13. The toner density control device of claim 10, wherein the characteristic value is a resonance frequency for detecting a permeability of the developer in accordance with the toner density.

14. The toner density control device of claim 10, wherein said sensing means comprises a Hall element.

15. The toner density control device of claim 10, further comprising memory means for storing said initial adjustment value set by the adjustment value setting means.

16. The toner density control device of claim 10, wherein said selecting means comprises a multiplexer.

17. The toner density control device of claim 10, wherein the signal means comprises a phase-locked loop.

18. The toner density control device of claim 15, wherein said memory means comprises a non-volatile memory means.

19. The toner density control device according to claim 10, wherein said given toner density is that of an unused developer.

20. The toner density control device according to claim 10, wherein said given toner density is that of a standard developer.

21. The toner density control device according to claim 1, wherein said selecting means sequentially selects each one of said plurality of sensing means to be coupled to said signal means.

22. The toner density control device according to claim 1, wherein said reference signal of a given type is a voltage signal and said characteristic value of the sensing means is a phase signal, and said processing means converts said phase signal to a voltage signal.

23. The toner density control device according to claim 22, wherein said processing means amplifies the phase signal of the characteristic value which has been converted to a voltage signal to within a predetermined range of said given value of the reference signal.

24. The toner density control device according to claim 1, wherein said reference signal of a given type is a voltage signal, and wherein said processing means amplifies a signal related to the characteristic value to within a predetermined range of said given value of the reference signal.

* * * * *